US006438967B1

(12) United States Patent
Sarwinski et al.

(10) Patent No.: US 6,438,967 B1
(45) Date of Patent: Aug. 27, 2002

(54) CRYOCOOLER INTERFACE SLEEVE FOR A SUPERCONDUCTING MAGNET AND METHOD OF USE

(75) Inventors: Raymond E. Sarwinski; William E. Stonecipher, both of San Diego; Bruce C. Breneman, Rancho Santa Fe, all of CA (US)

(73) Assignee: Applied Superconetics, Inc., San Diego, CA (US)

( * ) Notice: Subject to any disclaimer, the term of this patent is extended or adjusted under 35 U.S.C. 154(b) by 0 days.

(21) Appl. No.: 09/915,916

(22) Filed: Jul. 26, 2001

Related U.S. Application Data

(63) Continuation of application No. 09/881,642, filed on Jun. 13, 2001.

(51) Int. Cl.[7] ..... F25B 9/00; F28F 7/00
(52) U.S. Cl. ..... 62/6; 62/259.2; 165/185
(58) Field of Search ..... 62/6, 259.2; 165/185

(56) References Cited

U.S. PATENT DOCUMENTS 4,344,302 A * 8/1982 Jarrett et al. ..... 165/185
4,501,131 A * 2/1985 Gaskin et al. ..... 62/6
5,386,870 A * 2/1995 Nieman et al. ..... 165/1
5,680,768 A * 10/1997 Rattray et al. ..... 62/6
6,029,458 A * 2/2000 Eckels ..... 62/47.1
6,038,867 A * 3/2000 Einzinger et al. ..... 62/45.1
6,256,999 B1 * 7/2001 Chase ..... 62/6
6,305,174 B1 * 10/2001 Binneberg et al. ..... 62/6

* cited by examiner

*Primary Examiner*—William C. Doerrler
(74) *Attorney, Agent, or Firm*—Nydegger & Associates

(57) ABSTRACT

A method for cooling a superconducting device by using a sleeve assembly which thermally interconnects a two stage cryocooler with the device. In operation, the cryocooler is moveable relative to the sleeve assembly between a first configuration wherein the cryocooler is engaged with the sleeve assembly, and a second configuration wherein the cryocooler is disengaged from the sleeve assembly. The cryocooler is disposed in the sleeve assembly with the cooling element of the cryocooler positioned at a distance from the cylinder of the sleeve assembly to establish thermal communication therebetween. Also, the cooling probe of the cryocooler is in contact with the receptacle of the sleeve assembly and is urged against the receptacle to establish thermal communication therebetween. A bellows joins the cryocooler with the sleeve assembly to create an enclosed chamber therebetween and helium is pumped into the sleeve assembly to maintain an operational pressure in the sleeve assembly.

20 Claims, 2 Drawing Sheets

CRYOCOOLER INTERFACE SLEEVE FOR A SUPERCONDUCTING MAGNET AND METHOD OF USE

This application is a continuation of application Ser. No. 09/881,642 filed Jun. 13, 2001, which is currently pending. The contents of application Ser. No. 09/881,642 are incorporated herein by reference.

FIELD OF THE INVENTION

The present invention pertains generally to coupling assemblies for thermally connecting a cryocooler with an apparatus that is to be cooled. More particularly, the present invention pertains to a method for cooling a superconducting device by using a sleeve assembly which thermally interconnects two stages of a cryocooler with two different components of a superconducting device simultaneously. The present invention particularly, though not exclusively, pertains to a method for using a sleeve assembly to thermally disconnect the pulse tube, two stage cryocooler from a superconducting device without compromising the thermal condition of the superconducting device.

BACKGROUND OF THE INVENTION

It is well known that superconductivity is accomplished at extremely low temperatures. Even the so-called high temperature superconductors require temperatures which are as low as approximately twenty degrees Kelvin. Other not-so-high temperature superconductors require temperatures which are as low as approximately four degrees Kelvin.

In any case, there are numerous specialized applications for using superconducting devices that require low temperatures. One specialized application, for example, involves medical diagnostic procedures using magnetic resonance imaging (MRI) techniques. When used for medical diagnosis, MRI techniques require the production of a very strong and substantially uniform magnetic field. If superconducting magnets are used to generate this strong magnetic field, some type of refrigeration apparatus will be required to attain the low operational temperatures that are necessary.

To attain the low operational temperatures that are necessary for a superconducting device, the refrigeration apparatus typically includes separate cryogenic units or cryocoolers that are thermally connected with the superconducting device. During operation of the superconducting device, such a connection is essential. There are times, however, when it is desirable for the cryocooler to be selectively disconnected or disengaged from the superconducting device. For example, during repair or routine maintenance of the cryocooler in a refrigeration apparatus, it is much easier to work on the cryocooler when it is disconnected from the superconducting device it has been cooling. Importantly, when so disengaged, the cryocooler can be warmed to room temperature for servicing. Any disengagement of the cryocooler from the superconducting device, however, must allow for a reengagement. Further, it is desirable that the superconducting device be held at a very low temperature during disengagement.

As it is known to persons skilled in the pertinent art, new generation cryocoolers, such as "Pulse Tubes", cannot be "gutted" out and rebuilt as can the older generation cryocoolers. Instead, these pulse tube cryocoolers must either be entirely replaced or warmed to room temperature for servicing. It is, therefore, necessary for these new generation cryocoolers to use a refrigeration apparatus or a sleeve to cool a superconducting device. Because the entire pulse tube needs to be removed for servicing, the pulse tube cryocoolers cannot be directly and permanently bolted to the sleeve and, thus, the superconducting device. Further, the pulse tube internals cannot be removed independently as they can in many Gifford McMahon (GM) two stage cryocoolers.

For an effective thermal connection, it is known that the efficacy of heat transfer from one body to another body is dependent on several factors. More specifically, the amount of heat (Q) that is conductively transferred through a solid body or conductively transferred from one body to another body through a gas or liquid can be mathematically expressed as:

$$Q=k(A/L)\Delta T$$

In the above expression, k is the coefficient of thermal conductivity; A is the solid bodies cross-sectional area, or the surface area in contact between the two bodies for gas or liquid conduction; L is the solid bodies thermal length or the gap distance between the bodies; and $\Delta T$ is the temperature differential across the solid or between the two bodies. From this expression, it can be appreciated that in order to effectively cool one body (e.g. a superconducting device) with another body (e.g. a cryocooler) the transfer of heat, Q, must be accomplished. When the temperature differential between the bodies is desired to be very low, and for a given coefficient of thermal conductivity, it is necessary that the ratio of A/L be sufficiently high.

For any two separate bodies that are in contact with each other, even though they may be forced together under very high pressures, there will always be some average gap distance, L, between the interfacing cross-sectional surface areas of the bodies. For the case wherein there is a vacuum in the gaps, the gaps can create undesirable thermal insulators. Accordingly, it may be beneficial to have these gaps filled with a gas, such as helium. If this is done, heat transfer between the bodies in contact can result from a) solid conduction where there is actual contact between the bodies; b) molecular/gas conduction across the helium-filled gaps; and possibly c) liquid conduction in gaps where the gas has liquefied.

In light of the above, it is an object of the present invention to provide a method for cooling two components of a superconducting device by using a sleeve assembly that thermally interconnects two stages of a pulse tube cryocooler with the superconducting device. Another object of the present invention is to provide a method for cooling a superconducting device by using a sleeve assembly which allows the pulse tube, two stage cryocooler to be thermally disengaged from the superconducting device while the very low temperature of the superconducting device is substantially maintained. Still another object of the present invention is to provide a method for cooling a superconducting device which is effectively easy to implement and comparatively cost effective.

SUMMARY OF THE PREFERRED EMBODIMENTS

The present invention is directed to a method for cooling a superconducting device by using a sleeve assembly which thermally interconnects a pulse tube, two stage cryocooler with a superconducting device. For the present invention, the sleeve assembly has a heat transfer cylinder, a heat transfer receptacle and a midsection which interconnects the heat transfer cylinder with the heat transfer receptacle.

In more detail, the midsection of the sleeve assembly is hollow and elongated and defines a passageway between the heat transfer cylinder and the heat transfer receptacle. The heat transfer cylinder of the present invention is also hollow and is annular-shaped, having an inner surface and an outer surface. The heat transfer receptacle is formed with a recess and has an inner surface and an outer surface. Importantly, the inner surface of the heat transfer receptacle that defines the recess is tapered. Both the heat transfer cylinder and heat transfer receptacle are preferably made of copper, aluminum or any other high thermal conductivity material. Furthermore, the midsection of the sleeve assembly is preferably made of stainless steel or any other low thermal conductivity material known in the art.

The structure of the sleeve assembly is dimensioned for the engagement with a cryocooler which includes a cooling element and a tapered cooling probe. As contemplated for the present invention, the cryocooler is moveable relative to the sleeve assembly between a first configuration wherein the cryocooler is engaged with the sleeve assembly, and a second configuration wherein the cryocooler is disengaged from the sleeve assembly. Specifically, the two stages of the cryocooler will thermally engage and disengage with the two components of the superconducting device simultaneously through the sleeve assembly.

In operation, the sleeve assembly is engaged with the cryocooler when the cryocooler is juxtaposed with the sleeve assembly to establish thermal communication between the cryocooler and the superconducting device through the sleeve assembly. In more detail, when juxtaposed, the tapered cooling probe of the cryocooler is urged against the heat transfer receptacle of the sleeve assembly to establish thermal communication therebetween. As stated above, the inner surface of the heat transfer receptacle is tapered for mating engagement with the tapered cooling probe of the cryocooler. This engagement, however, will not be perfect. Always, there is an average gap distance between the inner surface of the heat transfer receptacle and the tapered cooling probe of the cryocooler. As contemplated for the present invention, this gap distance varies within the range between zero and approximately two thousandths of an inch (0–0.002 inches). Importantly, under these conditions, the gap ratio, A/L, in the above expression for Q will be in the range between approximately 10,000 $in^2/in$ to approximately 50,000 $in^2/in$. Consequently, there can be effective heat flow, Q, even though the temperature differential, $\Delta T$, between the heat transfer receptacle and the tapered cooling probe is small.

When the cryocooler is engaged with the sleeve assembly (first configuration), the cooling element of the cryocooler is positioned at a very small gap distance from the inner surface of the heat transfer cylinder. Importantly, this gap distance needs to be small enough to establish effective thermal communication between the cooling element and the heat transfer cylinder. For the present invention, this gap distance will vary within the range between approximately one thousandth of an inch to approximately five thousandths of an inch (0.001–0.005 inches). Although the gap ratio, A/L, in this case will be higher than it is for the receptacle/probe interface, there will still be effective heat flow, Q.

In order for the cryocooler and sleeve assembly to move between the first (engaged) and second (disengaged) configurations, an expandable bellows is provided which joins the heat transfer cylinder of the sleeve assembly with the room temperature section of the cryocooler and creates an enclosed chamber therebetween. In operation, the bellows allows the cryocooler to be separated from the sleeve assembly with a space therebetween which will maintain a gaseous thermal insulation between the cryocooler and the sleeve assembly. Stated another way, there will be sufficient thermal insulation between the sleeve assembly and the cryocooler to maintain the sleeve assembly at a substantially same low temperature when the cryocooler is disengaged from the sleeve assembly and is warmed to room temperature.

It is important for the sleeve assembly to maintain two substantially low temperatures for it to continually cool the two separate components of the superconducting device. To do this, the sleeve assembly of the present invention is operationally connected to the superconducting device by a proximal conductor and a distal conductor. In more detail, the proximal conductor is attached between the outer surface of the heat transfer cylinder and a thermal shield of the superconducting device to establish thermal communication therebetween. Further, the distal conductor is attached between the outer surface of the heat transfer receptacle and the superconducting wires of the superconducting device to establish thermal communication therebetween.

By way of a pipe, helium gas is pumped selectively into and from the chamber of the sleeve assembly. As contemplated for the present invention, the introduction of helium gas into the space between the cryocooler and the sleeve assembly will prevent a vacuum from forming when the cryocooler is disengaged and displaced from the sleeve assembly. Also, helium gas is useful to establish molecular conduction between the sleeve assembly and the cryocooler for an effective thermal connection therebetween when these two components are engaged with each other.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
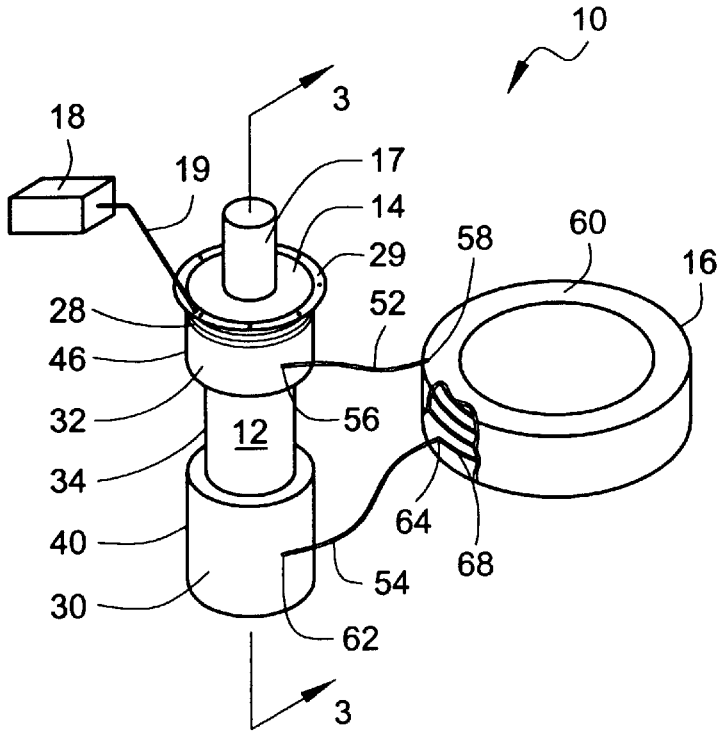
FIG. 1 is a schematic, perspective view of the sleeve assembly of the present invention engaged with a pulse tube, two stage cryocooler and shown operationally connected to a superconducting device, with portions broken away for clarity.

Referring initially to FIG. 1, a cooling system according to the present invention is shown and generally designated 10. More specifically, the cooling system 10 includes a sleeve assembly 12 which thermally interconnects a pulse tube, two stage cryocooler 14 with a superconducting device 16. As also shown, a helium source 18 is connected via a pipe 19 to the sleeve assembly 12. As intended for the present invention, the sleeve assembly 12 is an easily operated means for thermally connecting and disconnecting the cryocooler 14 from the superconducting device 16.

Figure 2:
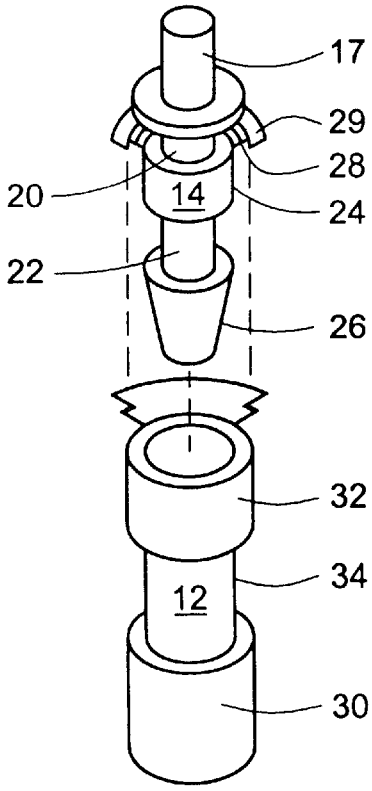
FIG. 2 is a perspective exploded view showing the sleeve assembly of the present invention in its structural relationship with a pulse tube, two stage cryocooler.

As shown in FIG. 2, the pulse tube, two stage cryocooler 14 has a valve motor body 17 having a first stage 20 (first cryocooler station) aligned with a second stage 22 (second cryocooler station). A cooling element 24 is disposed between the stages 20 and 22 and is in thermal communication with the first stage 20. As shown, a tapered cooling probe 26 extends from the second stage 22 and is in thermal communication with the second stage 22. As intended for the present invention, the second stage 22 maintains a temperature of approximately four degrees Kelvin (4° K) and cools the tapered cooling probe 26 to that same low temperature. Further, the first stage 20 maintains a temperature of approximately forty degrees Kelvin (40° K) and cools the cooling element 24 to that same temperature. Preferably, the cooling element 24 and the tapered cooling probe 26 of the cryocooler 14 can be both made of copper, aluminum or any other known high thermal conductivity material. A bellows 28 having a flange 29 is shown attached, with the flange 29, to the cryocooler 14. The pipe 19 that interconnects the helium source 18 with the sleeve assembly 12 is attached through the bellows flange 29 as shown in FIG. 1.

Still referring to FIG. 2, it will be seen that the sleeve assembly 12 includes a heat transfer receptacle 30, a heat transfer cylinder 32 and a midsection 34 which interconnects the heat transfer receptacle 30 with the heat transfer cylinder 32. It is important for the heat transfer receptacle 30 to be dimensioned to receive the tapered cooling probe 26 of the cryocooler 14. Similarly, the heat transfer cylinder 32 is dimensioned to receive the cooling element 24 of the cryocooler 14. The details of the structure of the sleeve assembly 12 can perhaps be best seen in FIGS. 3A and 3B.

Figure 3A:
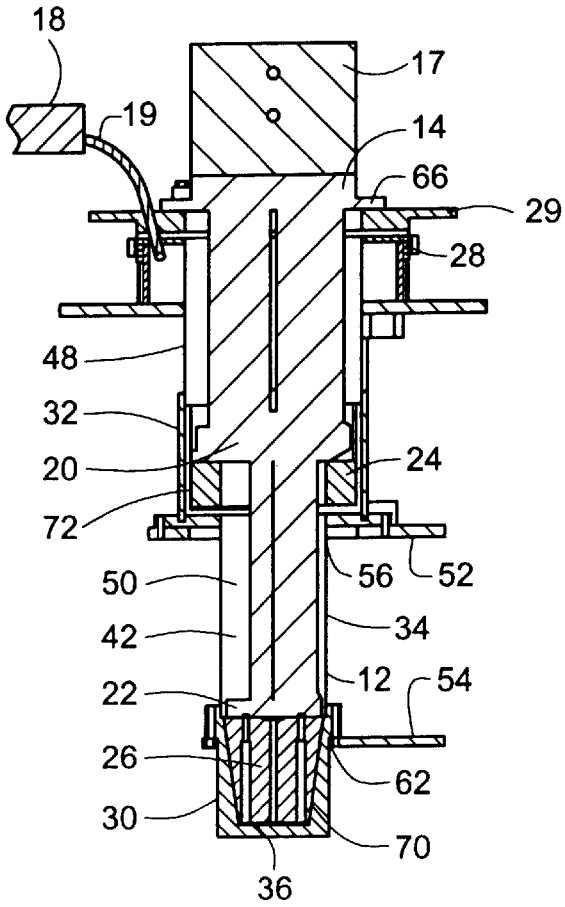
FIG. 3A is a cross-sectional view of the sleeve assembly and pulse tube, two stage cryocooler operationally engaged with each other as would be seen along the line 3—3 in FIG. 1.
Figure 3B:
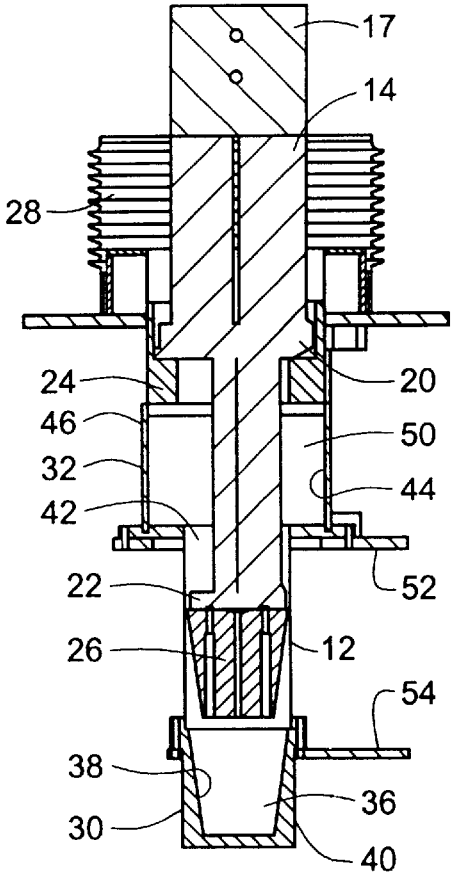
FIG. 3B is a cross-sectional view of the sleeve assembly and pulse tube, two stage cryocooler as seen in FIG. 3A when they are operationally disengaged from each other for the purposes of servicing the cryocooler.

In FIGS. 3A and 3B, the heat transfer receptacle 30 of the sleeve assembly 12 is formed with a recess 36 and has an inner surface 38 and an outer surface 40. Importantly, the inner surface 38 of the heat transfer receptacle 30 that defines the recess 36 is tapered. As also shown in FIGS. 3A and 3B, the midsection 34 of the sleeve assembly 12 is hollow and elongated and defines a passageway 42 between the heat transfer receptacle 30 and the heat transfer cylinder 32. The heat transfer cylinder 32 is also hollow and is annular-shaped, having an inner surface 44 and an outer surface 46. Preferably, the heat transfer receptacle 30 and the heat transfer cylinder 32 can be made of copper, aluminum or any other high thermal conductivity material. The midsection 34 of the sleeve assembly 12 can be made of stainless steel or any other low thermal conductivity material.

Referring back to FIG. 1, the sleeve assembly 12 is shown connected to two components of the superconducting device 16 by a proximal conductor 52 and a distal conductor 54. In more detail, the proximal conductor 52 has a first end 56 and a second end 58 and the distal conductor 54 also has a first end 62 and a second end 64. The first end 56 of the proximal conductor 52 is attached to the outer surface 46 of the heat transfer cylinder 32 and the second end 58 is attached to the thermal shield 60 of the superconducting device 16 as shown in FIG. 1. Similarly, the first end 62 of the distal conductor 54 is attached to the outer surface 40 of the heat transfer receptacle 30 and the second end 64 is attached to the wire 68 of the superconducting device 16 as shown in FIG. 1.

As shown in FIG. 3A, the flange 29 of expandable bellows 28 joins the room temperature flange 66 of cryocooler 14 with the heat transfer cylinder 32 of the sleeve assembly 12 by any means known in the art. With this interconnection, an enclosed chamber 50 is created between the sleeve assembly 12 and the cryocooler 14. (see FIG. 3B). Also, an elongated, thin stainless steel tube 48 is disposed between the bellows 28 and the heat transfer cylinder 32. Helium gas is pumped from the helium source 18 through the bellows flange 29 and into the chamber 50. Importantly, the bellows 28, with the helium gas present in the chamber 50, creates an air-lock seal between the sleeve assembly 12 and the cryocooler 14 to isolate the external environment from the superconducting device 16.

The cooperation of the sleeve assembly 12 of the present invention and the cryocooler 14 can perhaps be best appreciated by cross referencing FIGS. 3A and 3B. Specifically, the cryocooler 14 is moveable relative to the sleeve assembly 12 between a first configuration wherein the cryocooler 14 is engaged with the sleeve assembly 12 (FIG. 3A) and a second configuration wherein the cryocooler 14 is disengaged with the sleeve assembly 12 (FIG. 3B). Importantly, the first stage 20 and the second stage 22 of the cryocooler 14 engage and disengage simultaneously with the sleeve assembly 12. It is to be appreciated that when the cryocooler 14 is engaged with the sleeve assembly 12, the area to gap distance ratio, A/L, is very big. Specifically, when there is an engagement, the A/L is typically in the range between approximately 10,000 $in^2/in$ to approximately 50,000 $in^2/in$ and, thus, there is a very small temperature differential $\Delta T$. When the cryocooler 14 is disengaged from the sleeve assembly 12, the A/L will be in the range between approximately 10 $in^2/in$ to approximately 50 $in^2/in$. In this case where A/L is small, the $\Delta T$ is very big and, as a result, the transfer of heat, Q, is effectively not accomplished.

FIG. 3A shows the tapered cooling probe 26 of the cryocooler 14 urged against the recess 36 of the heat transfer receptacle 30 to establish thermal communication therebetween. As mentioned above, the heat transfer receptacle 30 is tapered for mating engagement with the tapered cooling probe 26 with a gap distance 70 between all of their respective interfacing surfaces. In general, this gap distance 70 between the tapered cooling probe 26 and the inner surface 38 of the heat transfer receptacle 30 may vary within a range between zero and approximately two thousandths of an inch (0–0.002 inches). Importantly, helium molecular/gas or liquid conduction is established through gap distance 70. FIG. 3A also shows the cooling element 24 of the cryocooler 14 positioned at a very small gap distance 72 from the inner surface 44 of the heat transfer cylinder 32. It is important for this gap distance 72 to be small enough to establish effective molecular/gas conduction through helium gas between the cooling element 24 and the heat transfer cylinder 32. On the other hand, there needs to be sufficient gap distance 72 for the cooling element 24 to be inserted into the heat transfer cylinder 32. As contemplated for the present invention, this gap distance 72 will vary within a range between approximately one thousandth of an inch to approximately five thousandths of an inch (0.001–0.005 inches).

FIG. 3B shows the cryocooler 14 disengaged with the sleeve assembly 12. The bellows 28 allows the cryocooler 14 to be separated from the sleeve assembly 12. There will be sufficient thermal insulation between the sleeve assembly 12 and the cryocooler 14 to maintain the sleeve assembly 12 at a substantially same low temperature when the cryocooler 14 is disengaged with the sleeve assembly 12. Meanwhile, the sleeve assembly 12 will remain in thermal communication with the superconducting device 16.

Operation

In the operation of the sleeve assembly 12 of the present invention, reference is first made to FIG. 2 wherein the pulse tube, two stage cryocooler 14 is shown being disposed the sleeve assembly 12. In more detail, as shown in FIG. 3B, the tapered cooling probe 26 of the cryocooler 14 is passed through the passageway 42 of the sleeve assembly 12 and is inserted into the recess 36 of the heat transfer receptacle 30 as shown in FIG. 3A. The cryocooler 14 is placed in the sleeve assembly 12 and is bolted to the bellows flange 29. When the tapered cooling probe 26 contacts the heat transfer receptacle 30, the second stage 22 of the cryocooler 14 is disposed in the passageway 42 of the sleeve assembly 12. Furthermore, the cooling element 24 of the cryocooler 14 is disposed in the heat transfer cylinder 32 of the sleeve assembly 12. Importantly, when the cryocooler 14 is engaged with the sleeve assembly 12, the A/L is very big. Specifically, A/L is typically in the range between approximately 10,000 $in^2/in$ to approximately 50,000 $in^2/in$ and therefore, the temperature differential, $\Delta T$, between the cryocooler 14 and the sleeve assembly 12, is very small.

As shown in FIG. 1, the superconducting device 16 is in thermal communication with the sleeve assembly 12 which, in turn, is in thermal communication with the cryocooler 14. Stated differently, thermal communication is established between the cryocooler 14 and the superconducting device 16 through the sleeve assembly 12. In more detail, via the distal conductor 54, the tapered cooling probe 26 will cool the wire 68 of the superconducting device 16 to approximately four degrees Kelvin (4° K). Similarly, via the proximal conductor 52, the cooling element 24 of the cryocooler 14 will cool the thermal shield 60 of the superconducting device 16 to approximately forty degrees Kelvin (40° K).

During the engagement or disengagement of the cryocooler 14 with the sleeve assembly 12, helium gas is pumped into the sleeve assembly 12 to establish molecular conduction between the cryocooler 14 and the sleeve assembly 12. Importantly, helium gas allows the three orders in magnitude difference in the A/L to act like a switch. This switch operation, therefore, allows for the engaging and disengaging between the cryocooler 14 and the sleeve assembly 12, as desired. Helium gas will also maintain an operational pressure between the sleeve assembly 12 and the cryocooler 14 as the cryocooler 14 moves between the first and second configurations.

To disengage the cryocooler 14 from the sleeve assembly 12 and to disconnect thermal communication therebetween, the cryocooler 14 is lifted from the sleeve assembly 12 by any mechanical means known in the art. The cryocooler 14, however, is not removed from the sleeve assembly 12. Instead, the cryocooler 14 is lifted just enough to thermally disconnect the cryocooler 14 from the sleeve assembly 12. It is important to note that when the cryocooler 14 is lifted from the sleeve assembly 12, the first stage 20 and the second stage 22 are simultaneously disengaged from their respective positions in the sleeve assembly 12, which, in turn, are simultaneously disengaged with their respective thermal communication with the superconducting device 16.

Upon thermal disengagement between the cryocooler 14 and the sleeve assembly, it is important to appreciate that the A/L between the two bodies becomes very small. Specifically, A/L is in the range between approximately 10 $in^2/in$ to approximately 50 $in^2/in$. As a result, $\Delta T$ is very big, and the transfer of heat is relatively insignificant.

As indicated above, the bellows 28 interconnects the cryocooler 14 with the sleeve assembly 12 to create a chamber 50 therebetween. Other than the bellows 28, there is no other mechanical connection between the sleeve assembly 12 and the cryocooler 14. Importantly, when the cryocooler 14 is disengaged from the sleeve assembly 12, A/L goes from being very large (approximately 10,000 $in^2/in$–approximately 50,000 $in^2/in$) to very small (approximately 10 $in^2/in$–approximately 50 $in^2/in$). As a result of this, thermal isolation is create. Furthermore, the bellows 28 maintains sufficient thermal insulation between the cryocooler 14 and the sleeve assembly 12 for the sleeve assembly 12 to maintain its substantially same low temperature.

Upon thermal disconnection between the cryocooler 14 and the sleeve assembly 12, the cryocooler 14 is warmed to room temperature for servicing. Meanwhile, the sleeve assembly 12 will remain in thermal communication with the superconducting device 16. Importantly, the superconducting device 16 will tend to maintain its cold temperature during disengagement (i.e. 4° Kelvin for the superconducting wires and 40° K for the thermal shield).

When the cryocooler 14 is disengaged from the sleeve assembly 12 for servicing, the cryocooler 14 will tend to expand as it is warmed to room temperature. It is, therefore, necessary to recool the cryocooler 14 prior to reengaging the cryocooler 14 with the sleeve assembly 12 in order for the cryocooler 14 to fit into the sleeve assembly 12. To do this, the stages 20 and 22 of the cryocooler 14 will cool the tapered cooling probe 26 and the cooling element 24 respectively and to their respective low temperatures. The cooled cryocooler 14 is then reengaged with the sleeve assembly 12 to establish thermal communication therebetween.

While the particular Cryocooler Interface Sleeve for a Superconducting Magnet and Method of Use as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for cooling portions of a superconducting device to temperatures below approximately six degrees Kelvin, said method comprising the steps of:

providing a cryocooler;

joining said cryocooler with a sleeve to create an enclosed chamber therebetween;

connecting said superconducting device with said sleeve for heat transfer therebetween; and selectively juxtaposing said cryocooler with said sleeve to establish thermal communication between said cryocooler and said superconducting device through said sleeve, via a conductor interconnecting said sleeve to said superconducting device.

2. A method as recited in claim 1 further comprising the step of pumping helium selectively into and from said chamber to maintain an operational pressure in said chamber and establish molecular conduction between said cryocooler and said sleeve.

3. A method as recited in claim 1 wherein said sleeve comprises a cylinder, a receptacle and a wall interconnecting said cylinder and said receptacle.

4. A method as recited in claim 3 wherein said cylinder and said receptacle are made of copper and said wall is made of stainless steel.

5. A method as recited in claim 3 wherein said juxtaposing step further comprises the steps of:

positioning a cooling element of said cryocooler at a first distance from said cylinder of said sleeve; and urging a cooling probe of said cryocooler against said receptacle of said sleeve with a second distance therebetween.

6. A method as recited in claim 1 wherein said connecting step between said sleeve and said superconducting device is accomplished with a first conductor being attached to an outer surface of said cylinder and a second conductor being attached to an outer surface of said receptacle, and wherein each said conductor is attached to said superconducting device.

7. A method as recited in claim 1 wherein said joining step is accomplished using a bellows attached between said cylinder of said sleeve and said cryocooler to create said chamber.

8. A method as recited in claim 5 wherein said first distance between said cooling element and said cylinder is in a range between approximately one thousandth of an inch to approximately five thousandths of an inch (0.001–0.005 inches) and further wherein said second distance between said cooling probe and said receptacle varies within a range between zero and approximately two thousandths of an inch (0–0.002 inches).

9. A method as recited in claim 1 wherein said cryocooler is a pulse tube, two stage cryocooler.

10. A method for cooling a superconducting device comprising the steps of:

providing a cooling means formed with a probe;

connecting a receptacle in thermal communication with said superconducting device via a conductor;

selectively juxtaposing said probe of said cooling means with said receptacle to establish thermal communication therebetween to draw heat from said superconducting device, through said conductor and said receptacle, and into said cooling means to cool said superconducting device; and maintaining a thermal insulation between said receptacle and said cooling means whenever said cooling means is distanced from said probe.

11. A method as recited in claim 10 wherein said receptacle is tapered for mating engagement with said probe of said cooling means and further wherein said probe is substantially in contact with said receptacle.

12. A method as recited in claim 10 wherein said connecting step is accomplished with a first conductor having a first end and a second end and further wherein said first end is attached to said receptacle and said second end is attached to said superconducting device to establish thermal communication therebetween.

13. A method as recited in claim 10 further comprising the steps of:

interconnecting a cylinder to said receptacle by a wall therebetween to define a sleeve, said sleeve having a chamber therein;

linking said cylinder in thermal communication with said superconducting device; and selectively disposing a cooling element of said cooling means in said cylinder to establish thermal communication therebetween to draw heat from said superconducting device, through said cylinder, and into said cooling means to cool said superconducting device.

14. A method as recited in claim 13 further comprising the step of pumping helium selectively into and from said chamber to maintain an operational pressure in said chamber and establish molecular conduction between said cooling means and said sleeve.

15. A method as recited in claim 13 wherein said cooling element is disposed at a distance from said cylinder, said distance being in a range between approximately one thousandth of an inch to approximately five thousandths of an inch (0.001–0.005 inches).

16. A method as recited in claim 13 wherein said linking step is accomplished with a second conductor having a first end and a second end and further wherein said first end is attached to said cylinder and said second end is attached to said superconducting device to establish thermal communication therebetween.

17. A method for cooling a superconducting device which comprises the steps of:

providing a pulse tube, two stage cryocooler having a cooling element and a tapered cooling probe;

connecting said superconducting device with a sleeve for heat transfer therebetween, said sleeve having a receptacle, a cylinder and a wall interconnecting said receptacle and said cylinder;

joining said sleeve with said cryocooler to create an enclosed chamber therebetween;

pumping helium selectively into and from said chamber to maintain an operational pressure in said chamber and establish molecular conduction and to maintain pressure balance between said sleeve and said cryocooler; and selectively moving said cryocooler relative to said sleeve between a first configuration wherein said sleeve is engaged with said cryocooler, where said tapered cooling probe is urged against said receptacle to establish thermal communication therebetween and said cooling element is positioned in said cylinder to establish thermal communication therebetween, and a second configuration wherein said cryocooler is disengaged from said sleeve.

18. A method as recited in claim 17 wherein said joining step is accomplished using a bellows attached between said cylinder of said sleeve and said cryocooler to maintain thermal insulation therebetween when said sleeve is in said second configuration.

19. A method as recited in claim 17 wherein said receptacle is tapered for mating engagement with said tapered cooling probe of said cryocooler and further wherein said tapered cooling probe is substantially in contact with said receptacle when said sleeve is in said first configuration.

20. A method as recited in claim 17 wherein said cooling element of said cryocooler is positioned at a distance from said cylinder when said sleeve is in said first configuration and further wherein said distance is in a range between approximately one thousandth of an inch to approximately five thousandths of an inch (0.001–0.005 inches).

* * * * *